US006447408B1

(12) United States Patent
Bonaventura

(10) Patent No.: US 6,447,408 B1
(45) Date of Patent: Sep. 10, 2002

(54) OCULAR ENHANCEMENT TRAINING SYSTEM

(76) Inventor: Michael Bonaventura, 1110 Church St., Evanston, IL (US) 60201

( * ) Notice: Subject to any disclaimer, the term of this patent is extended or adjusted under 35 U.S.C. 154(b) by 0 days.

(21) Appl. No.: 09/159,746

(22) Filed: Sep. 23, 1998

Related U.S. Application Data

(60) Provisional application No. 60/059,773, filed on Sep. 23, 1997.

(51) Int. Cl.[7] ..... A63B 69/00; A63B 57/00; F41F 7/00; F41B 7/00; F41B 15/00

(52) U.S. Cl. ..... 473/422; 473/451; 473/409; 124/1; 124/6; 124/16; 273/317.6; 273/445

(58) Field of Search ..... 473/415–422, 473/436, 431, 451–458, 409; 434/247–254, 258, 255; 124/7, 17, 6, 78, 16; 700/306; 273/446; 368/109, 251; 482/5, 110

(56) References Cited

U.S. PATENT DOCUMENTS 2,526,018 A * 10/1950 Foster et al. ..... 124/73
5,008,839 A * 4/1991 Goodwin et al. ..... 473/451
5,012,790 A * 5/1991 Bates ..... 124/6
5,020,794 A * 6/1991 Englehardt ..... 482/5
5,359,986 A * 11/1994 Magrath, III et al. ..... 124/1
5,398,665 A * 3/1995 Carlson ..... 124/17
5,443,260 A * 8/1995 Stewart et al. ..... 473/451
5,464,208 A * 11/1995 Pierce ..... 473/451
5,496,025 A * 3/1996 Phillips et al. ..... 124/16
5,549,302 A * 8/1996 Lapsker et al. ..... 473/451
5,562,282 A * 10/1996 Stevenson ..... 124/7
5,733,209 A * 3/1998 McIntyre, IV ..... 473/422
5,749,797 A * 5/1998 Snseri et al. ..... 473/451
5,816,953 A * 10/1998 Cleveland ..... 473/422
5,823,894 A * 10/1998 Actor ..... 473/422
5,832,909 A * 11/1998 Grant et al. ..... 124/6
5,846,086 A * 12/1998 Bizzi et al. ..... 434/247
5,890,995 A * 4/1999 Bobick et al. ..... 482/4

* cited by examiner

*Primary Examiner*—Paul T. Sewell
*Assistant Examiner*—Mitra Aryanpour
(74) *Attorney, Agent, or Firm*—Wallenstein & Wagner, Ltd.

(57) ABSTRACT

The present invention is a method for training a player of a game in which an object is projected towards the player at a normal velocity range. Depending on the application of the training method, the normal range of velocity for the projected object in the game is determined. An apparatus is provided for projecting the object at a velocity greater than the normal velocity range. The object is projected towards the player at the velocity greater than the normal velocity range. This routine is repeated to improve ocular conditioning and physical objects of the game.

12 Claims, 2 Drawing Sheets

OCULAR ENHANCEMENT TRAINING SYSTEM

CROSS REFERENCE TO RELATED APPLICATIONS

This application claims the benefit of U.S. Provisional Patent Application No. 60/059,773, filed Sep. 23, 1997.

TECHNICAL FIELD

The present invention relates to a conditioned ocular enhancement training system and method for training a player of a game in which an object is projected towards the player at a velocity within a normal velocity range.

BACKGROUND OF THE INVENTION

Various training programs and methods have been proposed to enhance the performance of athletes, including dietary programs, muscular development programs, aerobic conditioning programs, as well as programs and methods for sharpening the mental skills necessary to successfully compete at various competition levels. Programs which simulate competitive conditions have also been used to train athletes.

In addition, conditioning programs have been devised which subject an athlete to exaggerated conditions, i.e., conditions which the athlete would never encounter during normal competitive situations. The theory behind such exaggerated training programs is that after being continually subjected to extreme conditions, an athlete will be better prepared physically and mentally to perform under normal (i.e., less extreme) competitive conditions.

An exaggerated condition training program is commonly used in baseball where bat speed is crucial to successfully hitting a baseball. Before stepping into a batter's box to face live pitching, a batter will swing two or three baseball bats, or swing a single bat having a weight or "donut" slid down around the barrel of the bat. When the batter steps into the batter's box to face a pitcher, the batter's muscles are conditioned to swing a heavier bat. Accordingly, when the batter swings a lighter bat (i.e., a single bat or a bat without the a donut) the conditioned muscles will propel the bat at a greater speed.

Recently cross-training programs have been developed which combine training of various muscular groups, or muscular and aerobic development, and even programs which combine dietary conditioning with muscular, aerobic and mental training. However, ocular conditioning has been relatively unexplored as it relates to the performance of athletes.

SUMMARY OF THE INVENTION

It is an object of the present invention to provide an ocular enhancement conditioning program which can be used alone or in combination with a variety of other conditioning programs to enhance the performance of an athlete.

It is also an object of the present invention to provide a multimedia interface system and training method which employs exaggerated ocular conditioning to enhance a user's ability to view a moving object under different operating conditions.

It is yet another object of the present invention to combine ocular conditioning and physical training to provide a multimedia interface system and training method to improve an athlete's performance. Accordingly, the present invention can be used to train baseball players to focus on and follow a baseball propelled at velocities greater than the normal range of velocities the player will encounter during a game. The present invention can also be employed for training hockey goalies to focus on, follow and catch/block hockey pucks propelled at high velocities, or train tennis players to return high speed serves and other shots. Certain aspects of the present invention can also be used to train downhill skiers and race car drivers.

In a first aspect of the present invention a training method and system comprising a computer program for generating and displaying a moving object according to a variable set of operating parameters is provided. An operator can improve his ability to pick-up and follow moving objects by viewing the computer generated object at various speeds, angles of trajectory and the rate at which the display of the moving object is repeated.

In a second aspect of the training method and system of the present invention, the first step is repeated simulating a realistic competitive environment. For example, when the present training method and system is used to train a hockey goalie, a life size, three dimensional computer-generated display of a hockey player shooting a hockey puck at variable speeds, variable angles and under variable conditions (i.e., a break-away or with several players blocking the goalies view) is generated.

A third aspect of the present invention provides a virtual reality computer program, including the necessary hardware and software. The virtual reality program is capable of simulating all aspects of the competitive environment (e.g., lighting conditions, crowd conditions, noise conditions, etc.). The computer program generates a moving object according to a set of programmable operating parameters. The program can simulate and exaggerate velocities and trajectories of the moving object that a player might typically encounter during competition. The operating parameters can be programmed to display an entire game or just a consecutive sequence of opportunities (e.g., a single at bat in baseball or a single offensive set in hockey).

In a final aspect of the present invention, an apparatus is provided for projecting an object at an operator. The apparatus is capable of projecting the object at variable speeds, angles and intervals. The operator can attempt to hit, catch, or knock down the moving object as it is propelled towards him.

In each aspect of the invention, the operator begins viewing the object at a speed which the operator can comfortably follow and view. The speed of the object is slowly increased until the operator can no longer follow and view the moving object. At this point, the speed of the object is slowly decreased to a point where the operator can comfortably view the moving object once again. The cycle is repeated, gradually increasing the top speed at which the moving object is displayed.

DESCRIPTION OF THE INVENTION

Figure 1:
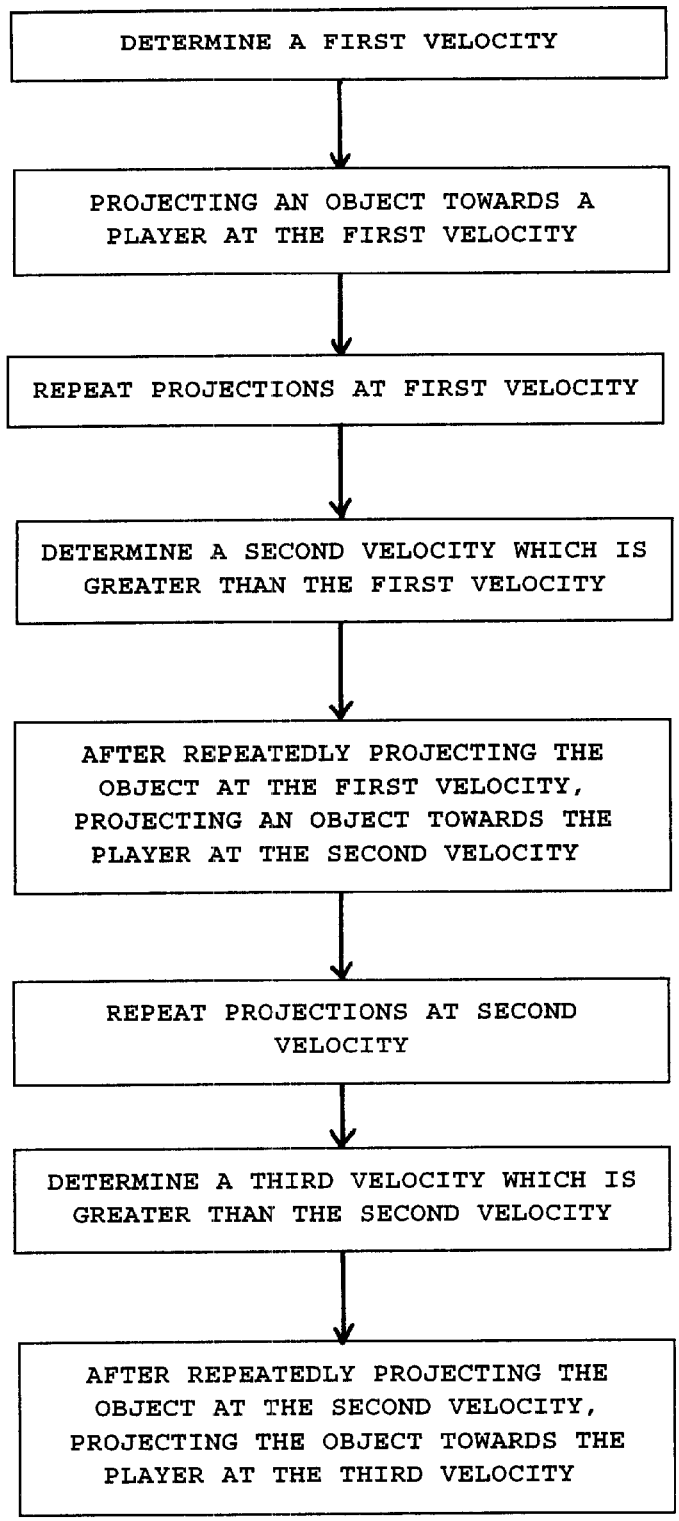
FIG. 1 is a block diagram of a method for training a player of a game according to one aspect of the present invention.

In a preferred embodiment, the conditioned ocular enhancement training system and method of the present invention comprises four general aspects. In the first aspect, a computer generated program displays a object moving at a predetermined rate of speed. The motion of the object is looped to repeat itself at variable rates of speed and angles of trajectory. An operator can vary several operating parameters, e.g., the rate of speed at which the program generates the displayed object, the rate of the repeated looping action, and the angle of trajectory before, during or after the generated display. In a preferred embodiment, the computer generated display will appear on a computer monitor or television screen in three dimensions (i.e., depth, width and height).

In the first aspect, the operator repeatedly views the moving object at predetermined operating parameters. Once the operator can focus on and follow the moving object at the predetermined parameters, the rate of speed at which the moving object is displayed is increased. The operator repeatedly views the moving object at the increased rate of speed until the operator can once again focus on and follow the moving object. Once again, the rate of speed at which the moving object is displayed is increased. This cycle is repeated until the operator can no longer focus on and follow the moving object. At this point, the speed of the moving object is either: (1) slowly decreased until the operator can focus on and follow the moving object again; or, (2) decreased to the initial operating speed wherein the entire process is repeated.

For example, in the first cycle the operator may view the moving object at approximately 80 miles per hour. After repeatedly viewing the object, a second cycle begins where the moving object is displayed at 85 mph; a third cycle at 90 mph; a fourth cycle at 95 mph. Finally, at some point, for example 120 mph or greater, the operator will no longer be able to follow and view the moving object. At this point, the speed of the moving object is either slowly decreased, (i.e., from 120 mph to 115 mph, incrementally back down to 80 mph) or immediately decreased to 80 mph wherein the entire process is repeated.

In both methods, the entire procedure is ultimately repeated. This time, however, the operator will attempt to follow and view the moving object at a top speed of 130 mph. Eventually, the top speed of the moving object will exceed 200 mph.

The second aspect is similar to the first, except that the computer generation displays a realistic simulation of a competitive environment. For example, if the conditioned ocular enhancement training system and method is being used to train a baseball player to follow and ultimately hit a pitched ball, a life-size computer generated display simulates a three dimensional view that a batter would see as he stood in a batter's box awaiting a pitched baseball, including a pitcher winding up and releasing the ball towards the operator. After repeatedly viewing the pitched ball at a set of initial predetermined operating parameters, the speed of the pitched ball is increased. As described above for the first step, the process is repeated slowly increasing the speed of the moving object until the operator can no longer focus on and follow the moving object. At this point, the speed of the moving object is either incrementally decreased until the operator can easily focus on and follow the moving object again, or the process is repeated at the initial operating speed. In either case, the entire process is repeated a predetermined number of times, each time subjecting the operator to a moving object at higher peak speeds. Eventually, the operator will be able to focus on and follow the moving object at higher rates of speed, and ultimately the operator will be able to improve his performance (e.g., hitting a ball in baseball or tennis, or catching/blocking a puck in hockey).

The third aspect of the system and training method comprises subjecting the operator to virtual reality conditions. In a preferred embodiment, the operator wears a helmet or goggles having a field upon which a three-dimensional, virtual reality program may be viewed. The program can simulate a variety of competitive situations; e.g., baseball, hockey, car racing, downhill skiing. The virtual reality conditions can also simulate real life factors which effect an athlete's ability to pick-up and view a moving object. In this respect, the program will factor in lighting conditions and crowd backdrop, as well as game situations which could detract from an athlete's ability to concentrate on a moving object (crowd noise and participating players movement).

Once again, the operator views the moving object at incrementally increased speeds until the operator can no longer focus on and follow the object. The speed of the moving object is then incrementally decreased until the operator can once again focus on and follow the object, or the speed is decreased to the initial operating speed. The entire process is repeated until the operator is subjected to peak speeds in excess of 200 mph.

In the third aspect, the operator will once again be able to program the operating parameters. However, the programmed operating parameters will be incorporated into a virtual competitive situation. For example, in a baseball environment, the operator can view each position of the opposing team, including the pitcher, as he steps up to home plate. The pitcher will appear to be throwing a baseball towards the operator according to the pre-determined operating parameters. The entire virtual sequence is viewed by the operator on the field provided by the helmet or goggles.

The final aspect of the system and training method comprises the integration of physical training with ocular conditioning. An apparatus is provided which is capable of projecting an object towards an operator at variable speeds, angles of projection and rates of repetition. The apparatus can be a Jugs™ machine used for training baseball players wherein a ball is propelled from between two rotating tires, or a pneumatic ball machine used to train tennis players such as those sold by Lobster, Inc. Preferably, the apparatus is of the pneumatic type wherein the pressure created in the machine is sufficient to project objects at velocities in excess of 200 mph.

Figure 2:
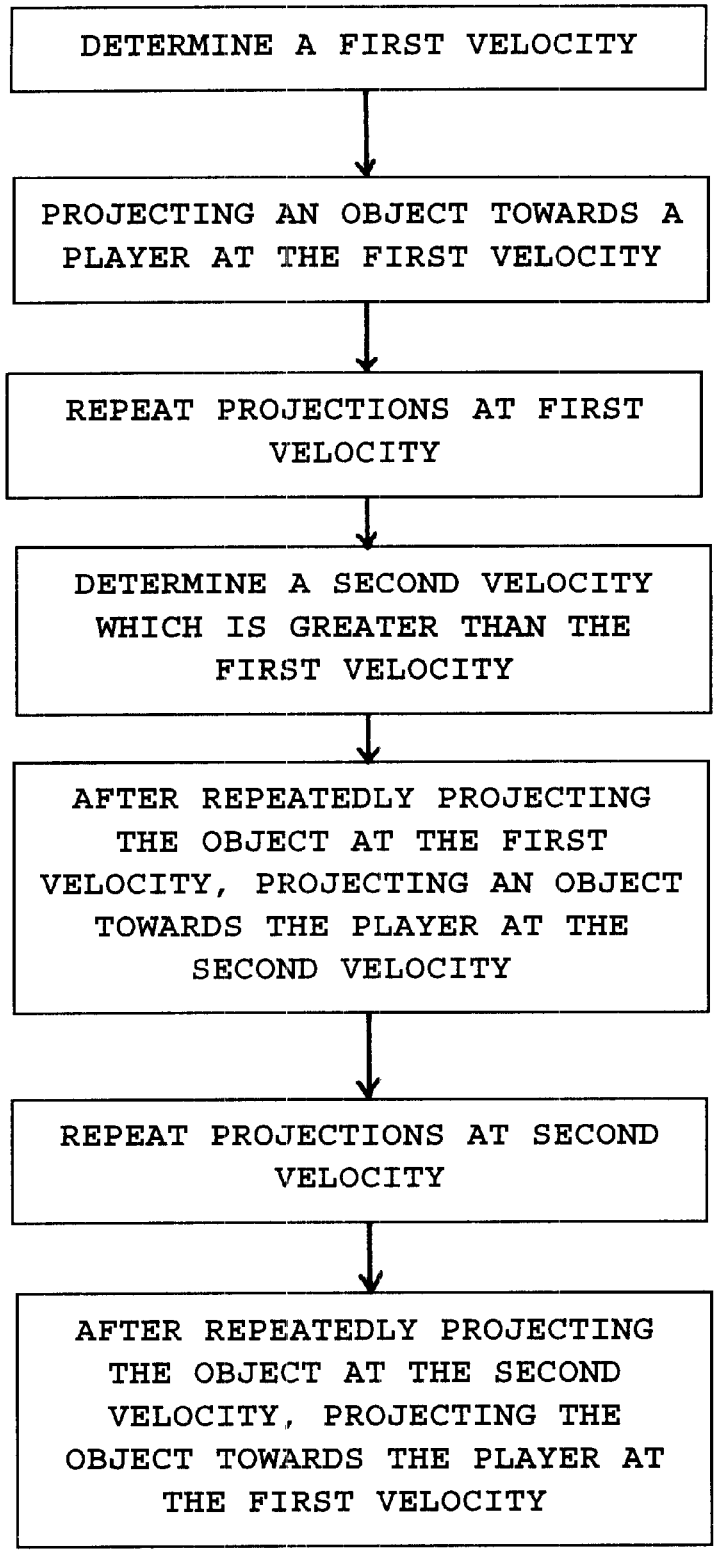
FIG. 2 is a block diagram of a method for training a player of a game according to another aspect of the present invention.

The player views the projected object at incrementally increased velocities until the operator can no longer focus on and follow the projected object. Similar to the first three aspects, the speed of the projected object is either incrementally decreased until the player can focus on and follow the projected object, or decreased to a velocity within the normal velocity range a player will be subjected to in game situations. For example, a player is subjected to a number of repetitions at 85 mph, then 95 mph, then 110 mph, then 130 mph, and preferably up to velocities in excess of 200 mph. See FIG. 1. The velocity is then reduced to a velocity within the normal range, e.g., about 80 mph to about 100 mph. See FIG. 2.

Unlike the first three aspects, in the final aspect the player focuses on and follows the projected object, and attempts to change the course of the projected object by hitting, catching, or knocking down the projected object. In this regard, the final aspect of the invention can be utilized by athletes immediately prior to competing in a game. For example, prior to a baseball game a player may take batting practice and be subjected to baseballs projected at velocities well above the normal range of velocity the player might encounter during an actual game situation; e.g., in professional baseball batters will encounter pitches in a normal velocity range of about 80 mph to about 100 mph. Thus, prior to the start of a game baseballs are repeatedly projected towards the player at a velocity greater than 100 mph, especially greater than 120 mph, and even greater than 140 mph. The player may simply focus on and follow the projected ball, or the player may incorporate the physical object of the game (e.g., hit a baseball with a bat, hit a tennis ball with a racket, or catch/block a hockey puck) into the training method. This allows the player to enhance his ocular conditioning and improve his physical skills. Consequently, the player is better conditioned to achieve the physical object of the game when subjected actual game situations where the object is propelled in the normal range of velocity (i.e., much less than the training range of velocity). Especially good results have been proven where a player is subjected to this method over an extended period of time; e.g., 10–20 days, a month or even an entire season.

The method of training of the present invention can be easily applied to other games and sports. For example, in tennis the method can be used to train a player to return an opposing player's serve which can reach a normal velocity range of about 90 mph to about 120 mph. In this case, a player is subjected to tennis balls projected at velocities of greater than 140 mph, especially greater than 160 mph and even greater than 200 mph. The same is true for training a hockey goalie who may be subjected to shots in a normal velocity range of about 80 mph to about 110 mph.

I claim:

1. A method for providing ocular enhancement for training a player of a game in which an object is projected towards the player at a predetermined first velocity range to increase the ocular focus of the player, the method being performed in the single training session and comprising the steps of:

providing an apparatus for sequentially varying the velocity of a projected object and for projecting a plurality of objects towards the player one at a time;

enhancing the ocular focus of the player by sequentially varying the velocity of a projected object during a single training session, wherein the step of enhancing the ocular focus comprises a plurality of sequential steps, the sequential steps comprising:

determining the first range of velocity;

projecting a first set of the plurality of objects towards the player within the first range of velocity;

subsequently increasing the velocity at which a second set of the plurality of objects is projected towards the player to a second velocity range which is greater than the first velocity range to increase the players ocular focus at the second range of velocity; and subsequently decreasing the velocity at which a third set of the plurality of objects is projected towards the player to a third velocity range which is within the first velocity range.

2. The method of claim 1, further including the step of attempting to change the course of each projected object through an act of the player.

3. The method of claim 1, wherein the game is baseball and the first range of velocity is 80 mph to 100 mph.

4. The method of claim 3, wherein the second quantity of the plurality of objects is projected towards the player at a velocity greater than 110 mph.

5. The method of claim 1, wherein the game is tennis and the first range of velocity is 90 mph to 120 mph.

6. The method of claim 5, wherein the second quantity of the plurality of objects is projected towards the player at a velocity greater than 140 mph.

7. The method of claim 1, wherein the apparatus includes pneumatic means for projecting the plurality of objects one at a time towards the player.

8. A method to practice batting for increasing the ocular focus of a batter, the method being performed in a single training session and comprising the steps of:

providing an apparatus for sequentially varying the velocity of a projected object and for projecting a plurality of balls one at a time towards the batter;

providing the batter with a bat;

enhancing the ocular focus of the player by sequentially varying the velocity of a projected object during a single training session, wherein the step of enhancing the ocular focus comprises a plurality of sequential steps, the sequential steps comprising:

projecting a first set of the plurality of balls one at a time towards the batter at a first velocity, the batter randomly attempting to hit the balls with the bat;

subsequently projecting a second set of the plurality of balls one at a time towards the batter at a second velocity greater than the first velocity to increase the players ocular focus at the second range of velocity, the batter randomly attempting to hit the balls with the bat;

subsequently projecting a third set of the plurality of balls one at a time towards the batter at a third velocity greater than the second velocity to increase the players ocular focus at the third range of velocity, the batter randomly attempting to hit the balls with the bat; and subsequently projecting a fourth set of the plurality of balls one at a time towards the batter at a fourth velocity which is less than the third velocity, the batter randomly attempting to hit the balls with the bat.

9. The method of claim 8 wherein the first velocity is less than 80 mph.

10. The method of claim 8 wherein the first velocity is greater than 80 mph.

11. The method of claim 8, wherein the second velocity is in a range of 80–100 mph.

12. The method of claim 8, wherein the third velocity is greater than 110 mph.

* * * * *